US006157290A

United States Patent [19]

Glatz-Reichenbach et al.

[11] Patent Number: 6,157,290

[45] Date of Patent: Dec. 5, 2000

[54] RESISTOR ELEMENT

[75] Inventors: Joachim Glatz-Reichenbach, Baden-Dättwil; Ralf Strümpler, Gebenstorf, both of Switzerland; Jörgen Skindhoj, Frederiksberg, Denmark; Felix Greuter, Baden-Rütihof, Switzerland

[73] Assignee: ABB Research Ltd., Zurich, Switzerland

[21] Appl. No.: 09/226,170

[22] Filed: Jan. 7, 1999

[30] Foreign Application Priority Data

Jan. 9, 1998 [DE] Germany ..... 198 00 470

[51] Int. Cl.[7] ..... H01C 7/10

[52] U.S. Cl. ..... 338/22 R; 338/225 D

[58] Field of Search ..... 338/22 R, 225 D, 338/202; 252/518, 513, 512

[56] References Cited

U.S. PATENT DOCUMENTS

| | | | |
|---|---|---|---|
| 5,313,184 | 5/1994 | Greuter et al. . | |
| 5,378,407 | 1/1995 | Chandler et al. | 252/513 |
| 5,798,060 | 8/1998 | Brevett | 252/520.1 |

FOREIGN PATENT DOCUMENTS

| | | |
|---|---|---|
| 0576836A2 | 1/1994 | European Pat. Off. . |
| 3707503C2 | 4/1988 | Germany . |
| 4427161A1 | 2/1996 | Germany . |
| 19520869A1 | 12/1996 | Germany . |
| WO91/19297 | 12/1991 | WIPO . |

*Primary Examiner*—Lincoln Donovan
*Assistant Examiner*—Kyung S. Lee
*Attorney, Agent, or Firm*—Burns, Doane, Swecker & Mathis, L.L.P.

[57] ABSTRACT

The resistor body of a nonlinear resistor element having PTC characteristics includes a pulverulent first filler, whose material, e.g. $TiB_2$, TiC, VC, WC, $ZrBr_2$, $MoSi_2$, has a specific conductivity of at most $10^{-3}$ Ωcm and in which the particle sizes are between 10 and 40$\mu$, and also, in order to improve the voltage sustaining capability by extending the switching zone and to achieve uniform energy absorption, includes a likewise pulverulent second filler having varistor characteristics and particle sizes between 50 and 200$\mu$, whose specific resistance at field strengths ≧2000 V/cm such as occur in the switching region of the resistor element and above, is at most 50 Ωcm, preferably at most 15 Ωcm, the fillers being embedded in a matrix made of a thermoplastic, in particular HD polyethylene or a thermoset. The average particle size of the second filler should exceed that of the first filler by a factor of from 2 to 5. A potentially particularly suitable material for the second filler is SiC doped with Al, B, Ga, In, N, P, As, as is similarly doped ZnO.

14 Claims, 1 Drawing Sheet

RESISTOR ELEMENT

BACKGROUND OF THE INVENTION

1. Field of the Invention

The invention relates to a resistor element housing PTC characteristics. Such so-called PTC resistors have a resistance which, at a certain switching current density, increases by several orders of magnitude, and are used for current limiting purposes, especially in the event of a short circuit.

The marked increase in the resistance when the switching current density is reached is caused by the fact that, owing to the heating and expansion of the polymer matrix, which are due to increased energy absorption, the embedded conductive particles of the first filler are separated. What was found to be a drawback in this context was that this effect tends to concentrate in a switching zone which, while indeed extending over the cross section of the resistor element, is nevertheless relatively short in the current direction, so that the total voltage drops over a short distance and the predominant proportion of the converted electrical energy is produced in a very small volume. This can easily lead to arcing and damage to the resistor element. Furthermore, this causes a reduction in the sustain voltage of the element, i.e. the voltage said element is able to sustain without too large a leakage current after a short circuit has been broken.

2. Discussion of Background

Inter alia, attempts have been made to improve the relevant behavior of such resistor elements by admixing the material with a second filler having varistor characteristics. U.S. Pat. No. 5 313 184, for example, discloses a congeneric resistor element which includes from 5 to 30% (by vol.) of varistor material in powdered form as a second filler. Expectations regarding an improvement in the voltage sustaining capability of the resistor element were not, however, met in full.

SUMMARY OF THE INVENTION

Accordingly, one object of the invention is to improve congeneric resistor elements in such a way that their voltage sustaining capability is significantly increased.

This object is achieved by the features in the defining part of claim 1. In resistor elements according to the invention, the current is largely commuted to the second filler in a range of current densities and corresponding field strengths as typically occur in the switching region of the resistor element. This ensures that the formation of a narrow switching zone will not lead to immediate current interruption—possibly followed by arcing or a flashover—but that instead the current will briefly continue to flow via the particles of the second filler and, in the process, the switching zone will widen to the extent of being able to sustain even high voltages without damage to the resistor element.

The advantages thus achieved reside primarily in the fact that considerably higher short-circuit voltages can be interrupted and that the sustain voltage likewise is considerably higher than with known congeneric resistor elements. The relevant ratings of resistor elements according to the invention can otherwise only be achieved by means of complicated series-parallel connections of resistor elements and varistors.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
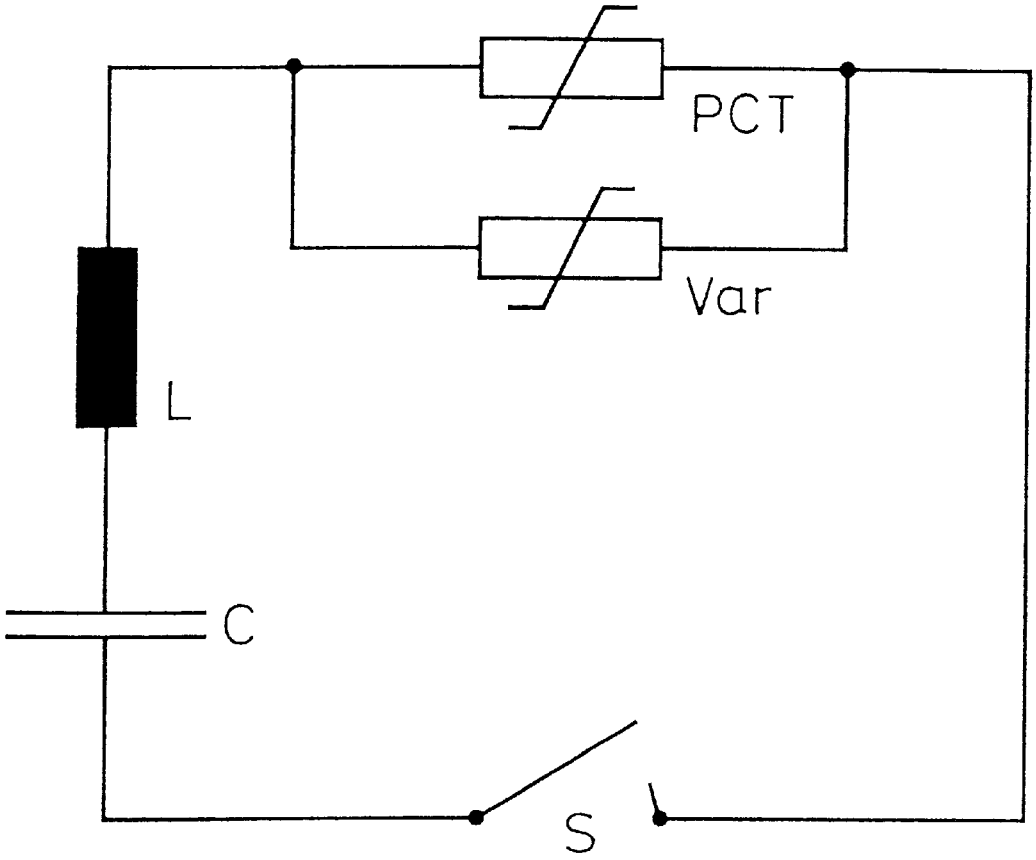
FIG. 1 shows the experimental setup which was used to obtain the results described below.

A number of mixtures were prepared by mixing, in each case, 50% (by vol.) of a matrix comprising the polyethylene HX5231 from BASF with 30% (by vol.) of a first filler, namely $TiB_2$ powder from Elektroschmelze Kempten, in which the particle sizes were distributed over a range of 10–30$\mu$, and 20% (by vol.) of a second filler. Only in the case of a reference sample Ref were 50% (by vol.) of the first filler admixed without a second filler. Hereinafter, the samples are designated in terms of the second filler. Specifically:

| | |
|---|---|
| ZnO | ZnO powder |
| Var | Powder of varistor material, i.e. ZnO doped with various metal oxides |
| ZnO+ | Powder of ZnO doped with Al |
| SiC + f (fine) | Powder of SiC doped with Al, particle sizes 45–75$\mu$ |
| SiC + m (medium) | Powder of SiC doped with Al, particle sizes 90–125$\mu$ |
| SiC + c (coarse) | Powder of SiC doped with Al, particle sizes 150–212$\mu$ |

The SiC doped with Al was procured from Elektroschmelze Kempten. ZnO was procured from Merck and was doped. The mixtures were used to fabricate resistor elements and experiments were carried out which involved these elements being incorporated in a circuit as shown in FIG. 1 and being subjected to short-circuit currents. To do this, a capacitor C was charged to 300 V, 850 V and 1200 V, respectively. The capacitor C and the inductor L, connected in series, were each selected so as to result in a short-circuit current of 12,000 A, based on 50 Hz. The short-circuit current was generated by a switch S being closed when capacitor C had been fully charged. The resistor element PTC being tested always had a varistor element Var connected in parallel therewith as an overvoltage protector. In addition to electrical parameters being measured, a thermocamera was used to take photographs of the resistor elements, thus enabling the energy distribution, in particular the length of the switching zone and any damage to be determined. One or two values for field strength, current density and specific resistance of the powders used as second filler were determined beforehand at a temperature of 25° C. and an electrode application force of 9.38 MPa.

The results obtained in the experiments can be found in the table at the end of the description. Blank fields in this table mean "not applicable", "\" means that no experiment was carried out, "–" means that the resistor element was damaged during the measurement, and "+" means that the resistor element survived the experiment without damage, but no values were measured.

The experimental results indicate that as far as expansion of the switching zone is concerned, the specific resistance of the second filler, measured on the powder with a sufficiently large electrode application force—it should if possible be several $MPa/cm^2$—is decisive for the length of the switching zone and consequently for a broad energy distribution. It should in any case be far below the values for the powders, measured for purposes of comparison, of undoped ZnO and of low-voltage varistor material which was prepared by sintering from D70 from Merck as a starting material. If at all possible, it should, at field strengths such as usually occur in the switching region—2000 V/cm and above—be at most 50 Ωcm, but preferably at most 20, or even better 15, Ωcm, values similar to those measured on powders of Al-doped ZnO and SiC.

Considerable importance also attaches to the particle sizes. If the particles of the second filler are no larger, or only insignificantly larger, than those of the first filler, they will probably not suffice for bridging after separation of the particles of the latter in the switching region. The second filler cannot achieve its function to the required degree. The average particle size of the second filler should therefore significantly exceed that of the first filler, preferably by at least a factor of 2. In the case of a relatively coarse-grain second filler, on the other hand, an irregular current distribution in the switching zone is observed, which leads to high local energy absorption and adversely affects the voltage sustaining capability of the resistor element. The factor by which the average particle size of the second filler exceeds that of the first filler should therefore generally not exceed 5.

Of course, materials other than the $TiB_2$ specified can be chosen as alternatives for the first filler, e.g. TiC, VC, WC, $ZrBr_2$, $MoSi_2$. What is important, particularly for the sake of good PTC characteristics, is a low specific resistance. This, if at all possible, should not exceed $10^{-3}$ Ωcm. For the second filler too, the specific resistance is of crucial importance, as explained hereinabove. The specific resistance of the material should not, if at all possible, be less than $10^{-2}$ Ωcm. The specific resistance of the powder at relatively low field strengths should, in any case, be high, so as to enable the resistor element to sustain a high sustain voltage in conjunction with a low leakage current. Only at the field strengths of at least 2000 V/cm, which occur in the switching region of the resistor element, should the specific resistance drop to the above-specified relatively low values, i.e. the powder should exhibit marked varistor characteristics. As well as by means of Al-doped SiC or ZnO, the various requirements regarding the second filler can also be met by means of SiC or ZnO doped with B, Ga, In or N, P, As, or by means of other appropriately doped semiconductors. For the polymer matrix, preference is given to a thermoplastic such as, for example, HD polyethylene or a thermoset.

In the first filler, the particle sizes, for the sake of rapid response, should be low and preferably should essentially be between 10μ and 40μ. In the second filler, they should, as mentioned, be higher, preferably between 50μ and 200μ. Of course, the composition of the resistor body can deviate from the one used in the experiments. Preference is given to proportions of from 30 to 70% (by vol.) for the first filler and between 10 and 40% (by vol.) for the second filler, the sum of these not exceeding 90% (by vol.) of the mixture.

Obviously, numerous modifications and variations of the present invention are possible in light of the above teachings. It is therefore to be understood that within the scope of the appended claims, the invention may be practiced otherwise than as specifically described herein.

TABLE

| Sample/ Measured value | Ref | ZnO | Var | ZnO+ | SiC + f | SiC + m | SiC + c |
|---|---|---|---|---|---|---|---|
| Field strength | | 3340 | 3250 | 3250 | 3164 | 2292 | 1888 |
| 2nd filler | | 4000 | 4000 | 4000 | | | |
| [V/cm] | | | | | | | |
| Current density | | 0.03 | $1.3 \times 10^{-4}$ | 92 | 174 | 169 | 172 |
| 2nd filler | | 0.04 | 0.05 | 156 | | | |
| [A/cm$^2$] | | | | | | | |
| Spec. resistance | | $1.1 \times 10^5$ | $2.5 \times 10^7$ | 33.5 | 18.2 | 13.5 | 11.0 |
| 2nd filler | | $1.0 \times 10^5$ | $8.0 \times 10^4$ | 26.0 | | | |
| [Ωcm] | | | | | | | |
| Switching zone [cm]/ | 0.3 | +/+ | 0.3 | \ | \ | 0.4 | 0.6 |
| Energy density [J/cm$^3$] | 890/+ | | 520/+ | | | 420 | 250 |
| at 300V/500V | | | | | | | |
| Switching zone [cm]/ | — | — | — | \ | \ | 1.8 | 1.8 |
| Energy density [J/cm$^3$] | | | | | | 250 | 216 |
| at 850V | | | | | | | |
| Switching zone [cm]/ | \ | \ | \ | 1.0 | 2.0 | 2.0 | — |
| Energy density [J/cm$^3$] | | | | 400 | 233 | 203 | |
| at 1200V | | | | | | | |

What is claimed as new and desired to be secured by Letters Patent of the United States is:

1. An electric resistor element including a resistor body which is disposed between two contact connections and comprises a polymer matrix and a first pulverulent filler made of a material having a specific resistance of at most $10^{-3}$ Ωcm and a second pulverulent filler having a specific resistance which decreases with increasing field strength, wherein the specific resistance of the second filler at field strengths ≧2000 V/cm does not exceed 50 Ωcm.

2. The resistor element as claimed in claim 1, wherein the specific resistance of the material of the second filler is at least $10^{-2}$ Ωcm.

3. The resistor element as claimed in claim 1, wherein the average particle size of the second filler exceeds that of the first filler.

4. The resistor element as claimed in claim 3, wherein the quotient of the average particle size of the first filler and the average particle size of the second filler is at least 2.

5. The resistor element as claimed in claim 3, wherein the quotient of the average particle size of the first filler and the average particle size of the second filler is at most 5.

6. The resistor element as claimed in claim 1, wherein the second filler comprises at least of the following materials: powder of doped SiC, powder of doped ZnO.

7. The resistor element as claimed in claim 1, wherein the particle sizes of the second filler are between 50μ and 200μ.

8. The resistor element as claimed in claim 1, wherein the first filler comprises powder of at least one of $TiB_2$, TiC, VC, WC and $ZrBr_2$.

9. The resistor element as claimed in claim 1, wherein the particle sizes of the first filler are between 10 micrometers and 40 micrometers.

10. The resistor element as claimed in claim 1, wherein the polymer matrix comprises a thermoplastic.

11. The resistor element as claimed in claim 10, wherein the thermoplastic comprises an HD polyethylene.

12. The resistor element as claimed in claim 10, wherein the thermoplastic comprises a thermoset.

13. The resistor element as claimed in claim 1, wherein the proportion of the first filler in the resistor body is between 30 and 70% by volume.

14. The resistor element as claimed in claim 1, wherein the proportion of the second filler in the resistor body is between 10 and 40% by volume.

* * * * *